US006142882A

United States Patent [19]

Anglea

[11] Patent Number: 6,142,882

[45] Date of Patent: Nov. 7, 2000

[54] BASE ANCHOR INDICATOR AND PLUG

[76] Inventor: James H. Anglea, 6111 Waterview, Arlington, Tex. 76016

[21] Appl. No.: 08/398,752

[22] Filed: Mar. 6, 1995

[51] Int. Cl.[7] ..... A63B 67/02

[52] U.S. Cl. ..... 473/150; 473/150; 116/209; 116/222; 404/10

[58] Field of Search ..... 273/32.5, 55 R; 116/63 R, 63 C, 312, 313, 314, 316, 322, 209, 222, 173; 404/6, 10, 12, 32, 15

[56] References Cited

U.S. PATENT DOCUMENTS

| | | | |
|---|---|---|---|
| 3,267,901 | 8/1966 | Carroll | 116/209 |
| 3,371,647 | 3/1968 | Shopbell | 116/209 |
| 4,852,512 | 8/1989 | Klatt | 116/209 |
| 4,862,823 | 9/1989 | Hughes | 473/150 |
| 5,044,303 | 9/1991 | Culver | 116/209 |
| 5,072,940 | 12/1991 | Bailey | 473/150 |
| 5,114,149 | 5/1992 | Bailey | 473/150 |
| 5,186,119 | 2/1993 | Hlavin | 273/55 R |
| 5,215,033 | 6/1993 | Gipp | 116/209 |
| 5,357,897 | 10/1994 | Bailey | 473/150 |
| 5,441,257 | 8/1995 | Sheaffer | 473/150 |
| 5,607,153 | 3/1997 | Bailey | 473/150 |

FOREIGN PATENT DOCUMENTS

| | | | |
|---|---|---|---|
| 2457655 | 6/1976 | Germany | 404/10 |

*Primary Examiner*—Jeanette Chapman
*Assistant Examiner*—Mitra Aryanpour
*Attorney, Agent, or Firm*—Harry C. Post, III

[57] ABSTRACT

A device used to plug an opening into and locate a receptacle in an anchor to a base employed on a playing field. The device has an elastic body that has a shape sufficiently large to extend across the opening of the receptacle. A flexible indicator is connected to the body and indicates the location of the body. The body is made from an elastomeric material capable of being deformed to insert a portion of the body through the opening into the receptacle and expands to form a plug across the opening to prevent access of dirt into the receptacle. The flexible indicator has a length sufficient to extend from the body and for a sufficient distance to be observed when the body is mounted with the receptacle and is sufficiently flexible to be deflected during ground care operations of the playing field and be visible after such ground care operations.

19 Claims, 2 Drawing Sheets

BASE ANCHOR INDICATOR AND PLUG

TECHNICAL FIELD

This invention relates to a device used for plugging an opening into and locating a receptacle in an anchor for a base used on a playing field.

BACKGROUND OF THE INVENTION

The use of bases or bags in the playing of baseball, softball and similar sporting activity is well known. The bases are located on and attached to the playing field by using a base anchor. The base anchor has a plate and a generally square tubular member connected to and extending perpendicularly away from the plate to form an open-ended receptacle. The plate is set in concrete below the surface of the playing field and positioned so that the receptacle extends upwardly with the open end facing toward the surface of the playing field. To prevent injury to a player, the open end of the receptacle generally does not extend on a level with or above the surface of the playing field. The base or bag is a foam covered square plate with a relatively flat back that rests on the surface of the playing field. A male member extends from the back of the square plate and is inserted through the open end of the receptacle connected to the base anchor. The male member moves within the receptacle toward the base anchor plate until the back of the base rests on the surface of the playing field.

It has been suggested that a resilient plug made of rubber or other elastomeric material be used for protecting an athlete from the metallic tube of the ground anchor, for preventing dirt from getting into the receiving tube, and as a locator to allow one to easily locate ground anchors. (See: U.S. Pat. No. 4,634,120)

In U.S. Pat. No. 4,634,120, a locator plug is suggested that has a tendency to retain dirt. The locator plug disclosed in this patent has a shaft that fits into the ground anchor receptacle. A head is connected to the shaft and has an upwardly extending locating pin for locating the plug when the shaft is fitted into the receptacle. When ground care or smoothing operations take place on the playing field, the base is removed and the shaft of this prior art plug is inserted into the receptacle and a drag is moved over the surface of the playing field to create a mound of dirt. When the plug is removed, the base will not rest uniformly on the playing field and either the surface of the playing field is further worked or the improperly mounted base creates a hazard to the players. To further work the area, an individual must rake or use other equipment to level the field. This takes additional time of the playing field worker and detracts from the sporting activity. The alternative is to allow the base to remain improperly mounted with a possible injury to a player.

Accordingly, it is an object of the present invention to provide a base anchor plug that allows a base anchor to be located and removed from the anchor without soil build up created during ground care operations.

Further, it is an object of the present invention to provide a base anchor plug that prevents dirt and other foreign matter from entering through an opening into the receptacle of a base anchor.

Further, it is an object of the present invention to provide an easily removed base anchor plug after ground care operations have taken place.

Further, it is an object of the present invention to provide a base anchor plug having an indicator and a device to permit easy removal of the plug from the receptacle after ground care operations have taken place.

DISCLOSURE OF THE INVENTION

In accordance with the present invention there is provided a device for plugging an opening into and locating a receptacle in an anchor to a base employed on a playing field. The device comprises an elastic body having a shape sufficiently large to extend across the opening of the receptacle. A flexible indicator is connected to the body to indicate the location of the body. The body is made from an elastomeric material capable of being deformed to insert a portion of said body through the opening into the receptacle and expanded to form a plug across the opening to prevent access of dirt into the receptacle. The flexible indicator has a length sufficient to extend from the body and for a sufficient distance to be observed when the body is mounted with the receptacle. The flexible indicator also is sufficiently flexible to be deflected during ground care operations of the playing field and be visible after such ground care operations.

Further, in accordance with the present invention there is provided a device is used for plugging an opening into and locating a receptacle in an anchor to a base employed on a playing field. The device comprises an elastic body having a shape sufficiently large to extend across the opening of the receptacle to form a plug. A flexible indicator is connected to the body to indicate the location of the body. The body is made from an elastomeric material capable of being deformed to insert a portion of the body through the opening into the receptacle and expanded to form a plug across the opening to prevent access of dirt into the receptacle. The flexible indicator has a length sufficient to extend from the body and above the playing field for a sufficient distance to be observed when the body is mounted with the receptacle. The flexible indicator also is sufficiently flexible to be deflected during ground care operations of the playing field and be visible after such ground care operations. Removing apparatus is connected to the body for withdrawing the body from the receptacle after ground care operations on the playing field have been completed and before a base is connected to the anchor.

BRIEF DESCRIPTION OF THE DRAWINGS

Other objects and advantages of the invention will become apparent upon reading the following detailed description and upon reference to the drawings, wherein like reference characters are used throughout to designate like parts.

BEST MODE FOR CARRYING OUT THE INVENTION

Now turning to the drawings, there is shown a device 10 constructed according to the present invention.

Figure 2:
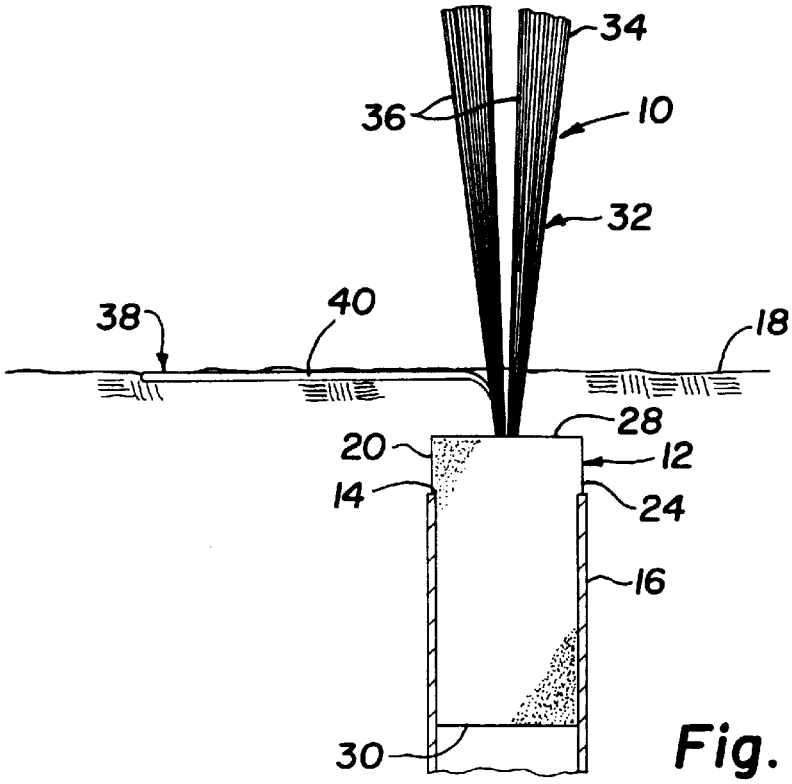
FIG. 2 is an elevational view of the device shown in FIG. 1 when mounted to a ground anchor receptacle and ground care operations completed.

A body 12 is used with device 10 to form a block or plug across opening or mouth 14 of receptacle 16, which is connected in a conventional manner to a conventional base ground anchor plate (not shown). Receptacle 16 is a conventional receptacle that is used in a base ground anchor and is typically a four sided tube. To assist in preventing injury to a player while permitting device 10 to be used, it is preferred that opening 14 of the base ground anchor be disposed beneath a surface 18 of the playing field and no more than three inches beneath surface 18. Surface 18 of the playing field has been prepared (i.e. the ground care operations are completed) and device 10 is ready to be removed from receptacle 16, as shown in FIG. 2.

Figure 1:
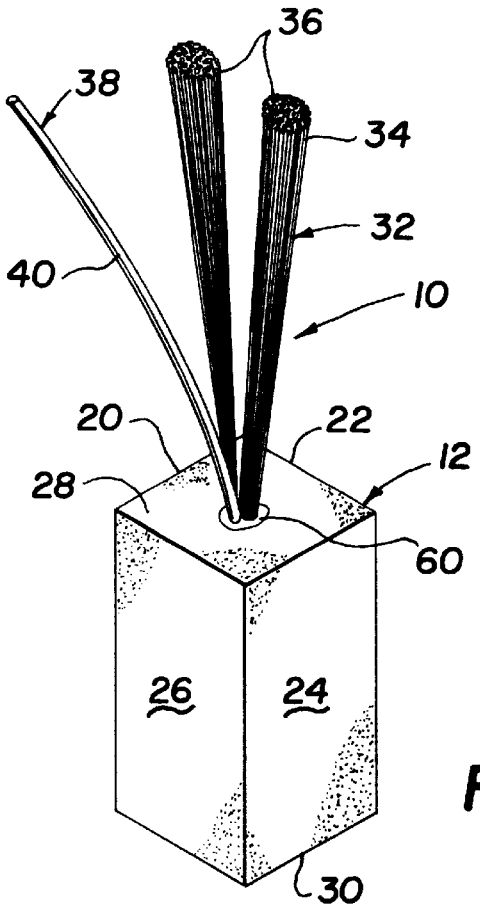
FIG. 1 is a perspective view of a device constructed according to the present invention.

Body 12 is made from a conventional elastomeric material, such as an elastic foam, that is capable of being deformed to insert a portion of body 12 through opening 14 into receptacle 16 and allowed to expand across opening 14 to form a plug across receptacle 16 and prevent access of dirt or other foreign matter into receptacle 16. The shape of body 12 generally conforms to receptacle 16 and has four sides, 20, 22, 24 and 26, respectively, that conforms to and agrees with the four sides of conventional receptacle 16, and is elongated so as to extend between a top 28 and a bottom 30, as shown in FIG. 1. Body 12 has a size sufficiently large so as to at least extend across opening 14 of receptacle 16 and form a block or plug in receptacle 16 when allowed to expand within receptacle 16. It has been discovered that the optimum plug for use with conventional receptacle 16 occurs when body 12 has a cross-section of four equal sides of about 1.6 inches per side and a length between top 28 and bottom 30 of about 3.15 inches.

A flexible indicator 32 is connected at top 28 to body 12 to indicate the location of body 12. Indicator 32 is sufficiently flexible to permit indicator 32 to be deflected to a position against or slightly beneath surface 18 of the playing field when the soil around receptacle 16 is worked and to return to the indicating position shown in FIG. 2 after the ground care operations are completed. Indicator 32 is made from a plurality of elongated bristle-like members 34 that are made from brightly colored plastic for easy observance and extend above top 28 of body 12 by a distance of about four and one-half inches to provide a viewing portion 36 of members 34.

A body removing device 38 is connected to body 12 for withdrawing body 12 from receptacle 16 after ground care operations on the playing field have been completed and before a base is connected to the anchor. Removing device 38 is flexible and includes a bundle of threads 40 twisted together with a length as long as or longer than the length of viewing portion 36 of indicator 32. Device 38 is made by twisting together a sufficient bundle of threads 40 to form a cord with sufficient strength to withdraw body 12 from receptacle 16 and removing the dirt piled over top 28 of body 12. When desired, device 38 may be made from a brightly colored material for easy observance and used as a flexible indicator in place of the preferred indicator 32, described above.

Figure 3:
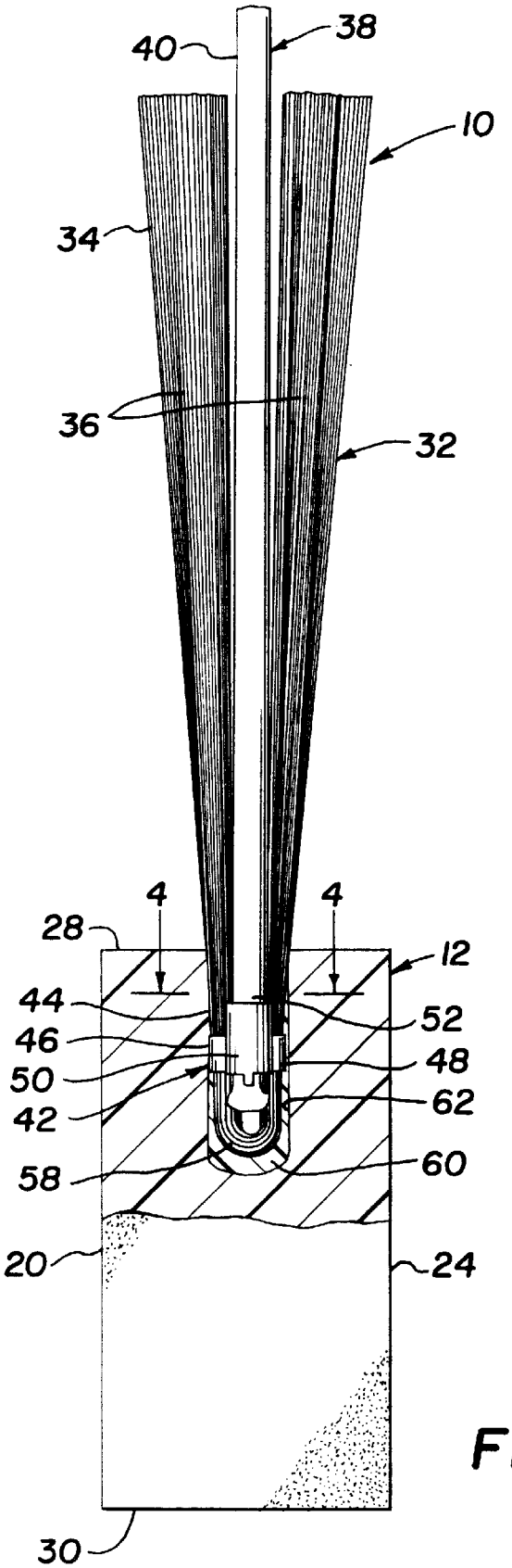
FIG. 3 is an enlarged elevational view of the device shown in FIG. 1, with a portion of the device being partly in section.
Figure 4:
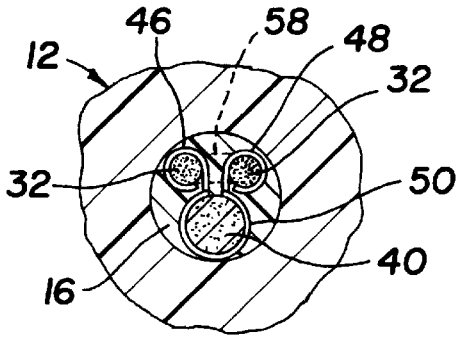
FIG. 4 is cross-sectional view of a portion of the device shown in FIG. 3 taken along lines 4—4, in the direction of the arrows.

As best seen in FIGS. 3 and 4, connecting apparatus 42 secures a connecting portion 44 of flexible indicator 32 to body 12 while allowing viewing portion 36 of flexible indicator 32 to extend outwardly above top 28 of body 12.

A clamp 46 is used in apparatus 42 and is secured to connecting portion 44 of flexible indicator 32 and to connecting portion 48 of cord 40. Clamp 46 is made from metal with a cord clamping portion 50 secured to an end 52 of cord 40, a first indicator clamping portion and a second indicator clamping portion. First and second indicator clamping portions, are provided when bristle-like members 34 are folded back upon themselves to form a fold 58 within connecting portion 44 of bristle-like members 34. It is preferred that fold 58 is located midway between the ends of bristle-like members 34. In this configuration, an enhanced visual effect is obtained by using half the number of elongated bristle-like members 34 with a length of about ten inches.

Clamp 46 and connecting portion 44 of flexible indicator 32 and connecting portion 48 of cord 40 are secured to body 12 by an adhesive 60 disposed within a passageway 62 formed within body 12.

In operation, at the end of a game or at any other time when surface 18 of the playing field is to be worked, a grounds keeper will remove the base for safe keeping and insert body 12 into receptacle 16 by squeezing body 12 with his hands. With indicator 32 extending away from opening 14 into receptacle 16, body 12 is inserted with bottom 30 facing and passing through opening 14. Body 12 is then released to allow it to expand and form a plug or block to prevent dirt or other foreign matter from entering receptacle 16. The grounds keeper will then perform the normal grounds care operation with a drag or rake to level surface 18 of the playing field. After completing the grounds care operations, indicator 32 is observed, the grounds keeper locates body removing device 38 and uses it to remove body 12 from receptacle 16. The male member of the base is then aligned with opening 14 of receptacle 16 and inserted into receptacle 16. The base is properly positioned on the playing field without additional repair work to provide a level surface for the playing field.

The invention having been described, what is claimed is:

1. A device used for plugging an opening into and locating a receptacle in an anchor to a base employed on a playing field, comprising: an elastic body having a shape sufficiently large to extend across the opening, said body being made from an elastomeric material capable of being deformed to insert a portion of said body through the opening and expanded to form a plug across the opening; a flexible indicator connected to said body to indicate the location of said body, said flexible indicator having a length sufficient to extend from said body when mounted with the receptacle disposed below a surface of the playing field and to extend above the playing field surface for a sufficient distance to be observed, and being sufficiently flexible to be deflected during ground care operations of the playing field and be visible after such ground care operations; and connecting means for securing a connecting portion of said flexible indicator within said body while allowing a visible portion of said flexible indicator to extend outwardly of said body.

2. A device as set forth in claim 1, further comprising: said elastic body further including the shape being a block that has a cross-section generally conforming to and larger than a cross-section of the opening.

3. A device used for plugging an opening into and locating a receptacle in an anchor to a base employed on a playing field, comprising: an elastic body having a shape sufficiently large to extend across the opening said body being made from an elastomeric material capable of being deformed to insert a portion of said body through the opening and expanded to form a plug across the opening; and a flexible indicator connected to said body to indicate the location of said body, said flexible indicator having a length sufficient to extend from said body when mounted with the receptacle disposed below a surface of the playing field and to extend above the playing field surface for a sufficient distance to be observed, and being sufficiently flexible to be deflected during around care operations of the playing field and be visible after such ground care operations, said flexible indicator further including a plurality of bristle-like members.

4. A device used for plugging an opening into and locating a receptacle in an anchor to a base employed on a playing field, comprising: an elastic body having a shape sufficiently large to extend across the opening, said body being made from an elastomeric material capable of being deformed to insert a portion of said body through the opening and expanded to form a plug across the opening; and a flexible indicator connected to said body to indicate the location of said body, said flexible indicator having a length sufficient to extend from said body when mounted with the receptacle disposed below a surface of the playing field and to extend above the playing field surface for a sufficient distance to be observed, and being sufficiently flexible to be deflected during around care operations of the playing field and be visible after such ground care operations, said flexible indicator further including a bundle of threads twisted together.

5. A device used for pluging an opening into and locating a receptacle in an anchor to a base employed on a playing field, comprising: an elastic body having a shape sufficiently large to extend across the opening, said body being made from an elastomeric material capable of being deformed to insert a portion of said body through the opening and expanded to form a plug across the opening; a flexible indicator connected to said body to indicate the location of said body, said flexible indicator having a length sufficient to extend from said body when mounted with the receptacle disposed below a surface of the playing field and to extend above the playing field surface for a sufficient distance to be observed, and being sufficiently flexible to be deflected during ground care operations of the playing field and be visible after such around care operations; and connecting means for securing a connecting portion of said flexible indicator to said body while allowing a visible portion of said flexible indicator to extend outwardly of said body, said connecting means further including a clamp secured to the connecting portion of said flexible indicator and fastening means for fastening the clamp and the connecting portion of said flexible indicator to said body.

6. A device as set forth in claim 5, further comprising: said connecting means further including the fastening means being an adhesive.

7. A device as set forth in claim 5, wherein: said flexible indicator further including a plurality of elongated bristle-like members, the bristle-like members being folded back upon themselves to form a fold within the connecting portion of the bristle-like members; and said connecting means further including a clamp securing the plurality of bristle-like members to one another in close proximity to the fold and fastening means for fastening the clamp and connecting portion of the bristle-like members to said body.

8. A device as set forth in claim 7, wherein: said connecting means further including the fastening means being an adhesive.

9. A device as set forth in claim 7, wherein: said flexible indicator further including the fold of the plurality of elongated bristle-like members being in close proximity to a point substantially midway between opposed ends of the members.

10. A device used for plugging an opening into and locating a receptacle in an anchor to a base employed on a playing field, comprising: an elastic body having a shape sufficiently large to extend across the opening to form a plug, said body being made from an elastomeric material capable of being deformed to insert a portion of said body through the opening and expanded to form a plug across the opening; a flexible indicator connected to said body to indicate the location of said body, body being made from an said flexible indicator having a length sufficient to extend from said body when mounted with the receptacle disposed below a surface of the playing field and to extend above the playing field surface for a sufficient distance to be observed, and being sufficiently flexible to be deflected during ground care operations of the playing field and be visible after such ground care operations; and removing means connected to said body for removing said body from the opening after ground care operations on the playing field have been completed and before a base is connected to the anchor.

11. A device as set forth in claim 10, wherein: said flexible indicator further including a plurality of bristle-like members.

12. A device as set forth in claim 10, wherein: said removing means being flexible and including a bundle of threads twisted together.

13. A device as set forth in claim 12, wherein: said removing means further including the bundle of threads twisted together forming a cord having sufficient strength to withdraw said body from the receptacle.

14. A device as set forth in claim 10, wherein: connecting means for securing a connecting portion of said flexible indicator and a connecting portion of said removing means to said body while allowing a portion to be observed above the playing field surface.

15. A device as set forth in claim 14, wherein: said connecting means further including a clamp secured to the connecting portion of said flexible indicator and said removing means and fastening means for fastening the clamp and the connecting portions of said flexible indicator and said removing means to said body.

16. A device as set forth in claim 15, wherein: said connecting means further including the fastening means being an adhesive.

17. A device as set forth in claim 14, wherein: said flexible indicator further including a plurality of elongated bristle-like members, the bristle-like members being folded back upon themselves to form a fold within the connecting portion of the bristle-like members; said removing means being flexible and including a bundle of threads twisted together, the bundle of threads twisted together forming a cord having sufficient strength to withdraw said body from the receptacle; and said connecting means further including a clamp securing the plurality of bristle-like members and an end of the cord to one another in close proximity to the fold, and fastening means for fastening the clamp and connecting portions of the bristle-like members and removing means to said body.

18. A device as set forth in claim 17, wherein: said connecting means further including the fastening means being an adhesive.

19. A device as set forth in claim 7, wherein: said flexible indicator further including the fold of the plurality of elongated bristle-like. members being in close proximity to a point substantially midway between opposed ends of the members.

* * * * *